United States Patent [19]

Buehler

[11] Patent Number: 4,567,683

[45] Date of Patent: Feb. 4, 1986

[54] HANDGUN SCOPE MOUNT

[76] Inventor: Maynard P. Buehler, 17 Orinda Way, Orinda, Calif. 94563

[21] Appl. No.: 547,990

[22] Filed: Nov. 2, 1983

[51] Int. Cl.[4] ..... F41G 1/38

[52] U.S. Cl. ..... 42/1 ST; 33/250

[58] Field of Search ..... 42/1 ST; 33/245, 250

[56] References Cited

U.S. PATENT DOCUMENTS

| | | | |
|---|---|---|---|
| 2,486,002 | 10/1949 | Buehler | 42/1 ST |
| 3,992,783 | 11/1976 | Dunlap et al. | 42/1 ST |
| 4,328,624 | 5/1982 | Ross | 42/1 ST |
| 4,341,022 | 7/1982 | Santoro | 42/1 ST |
| 4,383,371 | 5/1983 | Coffey | 42/1 ST |

OTHER PUBLICATIONS

Milek, "Scope Your Way to Handgun Accuracy", *The American Rifleman,* vol. 120, No. 1, pp. 35–38, Jan. 1972.

Krentz, "Scope Your Handgun for Higher Scores", *The American Rifleman,* Jun. 1974, pp. 34, 35.

*Primary Examiner*—Charles T. Jordan
*Assistant Examiner*—Ted L. Parr
*Attorney, Agent, or Firm*—Robert S. Smith

[57] ABSTRACT

A mount for a scope, which includes a base having depending side plates, each of the side plates having an inwardly extending lip. At least one of the side plates is detachable from the base, the base having first and second set screws disposed therein for engagement at spaced axial points along the top surface of the associated handgun.

3 Claims, 9 Drawing Figures

HANDGUN SCOPE MOUNT

BACKGROUND OF THE INVENTION

The invention relates to scope mounts and particularly to a scope mount for a handgun. A wide variety of scope mounts have been provided for handguns and these include the structures shown in the following U.S. Patents: Coffey No. 4,383,371; Santoro No. 4,341,022; Buehler No. 2,951,292; Buehler No. 2,486,002; Heinzel No. 3,579,840; Johannsen No. 4,299,044; Dunlap et al No. 3,992,783; and Burris No. 3,750,318.

These and other structures have not been wholly satisfactory. They have usually been dimensioned and configured to engage only one of the many types of handguns which are manufactured and sold. Many are complex and would require great manufacturing expense if they were commercially produced.

The prior art structures have not always provided a stable mount which holds the physical relationship of the scope to the handgun despite shocks such as the firing of the gun. It will be understood that the shocks involved in firing of weapons such as the 0.357 Magnum are very substantial.

It is an object of the invention to provide a structure which is simple and inexpensive to manufacture.

More specifically, it is an object of the invention to provide a structure which has a basic construction which may be slightly modified for specific handguns and, thus, is adaptable to substantially all handguns.

It is still another object of the invention to provide a structure which is simple and, thus, minimizes manufacturing costs.

Yet another object of the invention is to provide a structure which does not require drilling and tapping of the handgun or the presence of a dovetail.

Another object of the invention is to provide a structure which will maintain the physical relationship between the scope and the handgun despite the shocks associated with normal use including the firing of relatively powerful handguns such as the 0.357 Magnum.

SUMMARY OF THE INVENTION

The foregoing objects and other objects and advantages which shall become apparent from the detailed description of the preferred embodiment are attained in a mount for a scope, which includes a base having depending side plates. Each of the side plates has an inwardly extending lip. At least one of the side plates is detachable from the base, the base having first and second set screws disposed therein for engagement at spaced axial points along the top surface of the associated handgun. This structure positively aligns the mount base parallel both vertically and axially with the center line of the revolver bore.

Both of the side plates may be removably mounted on the base. The base may include a shoulder dimensioned and configured for engagement with an associated recoil shoulder on the associated handgun. The side plates may each be disposed in respective recesses in the base. The base may be dimensioned and configured for cooperation with a plurality of side plates having lips of various thicknesses for engagement with various handguns.

BRIEF DESCRIPTION OF THE DRAWING

The invention will be better understood by reference to the accompanying drawing in which.

DESCRIPTION OF THE PREFERRED EMBODIMENT

Figure 1:
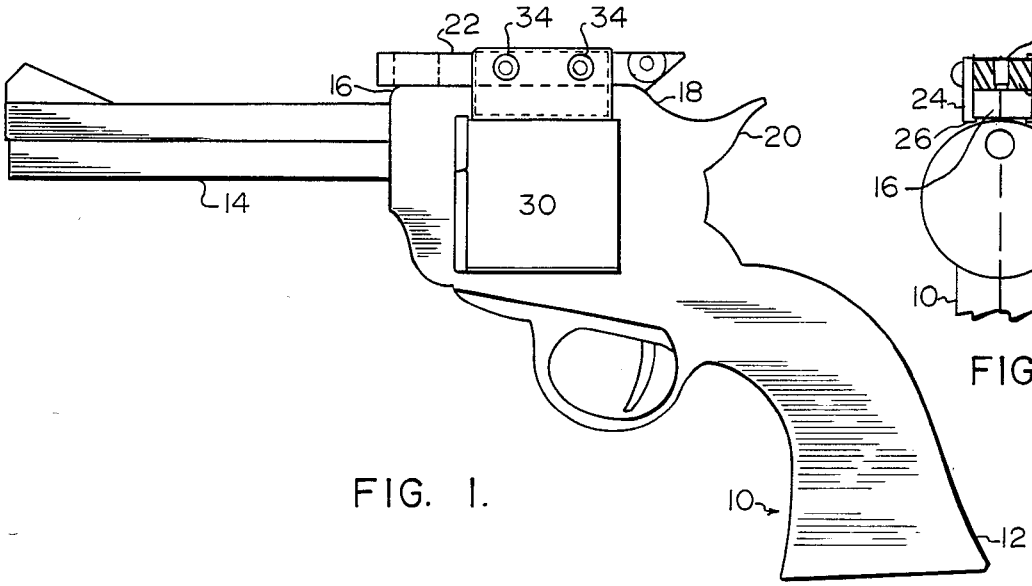
FIG. 1 is a side elevational view of a handgun on which the apparatus in accordance with the invention is installed.
Figure 2:
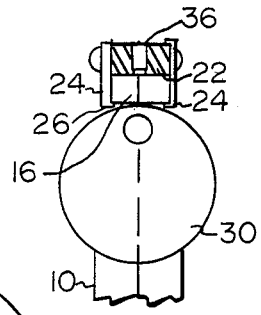
FIG. 2 is a broken away sectional view of FIG. 1.

Referring now to FIGS. 1 and 2, there is shown a revolver 10 having a grip 12 and a barrel 14. Extending along the top is a top strap 16. A recoil shoulder 18 is disposed along the top surface near a hammer 20. For simplicity the actual telescopic site has been omitted from the drawing. It will be understood that the preferred construction includes the structure by which the scope is attached by rings as described in U.S. Pat. No. 2,486,002, issued to the present applicant. The rings for the scope are mounted on a mount base 22, which is fixed in position by side plates or clamp plates 24 disposed in a substantially vertical plane and which are each provided with an inwardly extending lip 26 which engages the bottom of the top strap 16.

Figure 4:
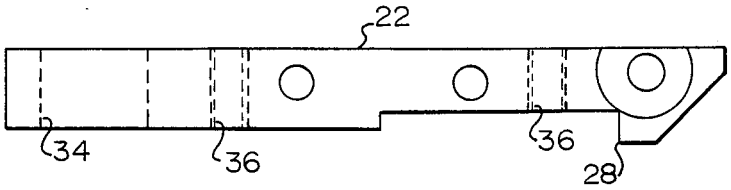
FIG. 4 is a side elevational view of the apparatus shown in FIG. 3.
Figure 6:
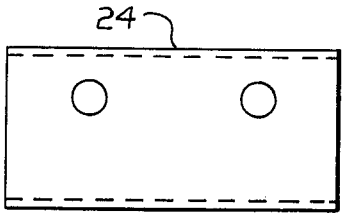
FIG. 6 is a side elevational view which is representative of the side elevational view of any of various side plates which may be used in the illustrated embodiment of the invention.

The mount base 22 is provided with a depending lip 28, as best seen in FIG. 4, which engages the recoil shoulder 18 of the associated handgun 10. This is particularly desirable in large bore firearms such as the 0.357 Magnum. In the absence of this structure the scope and its mounting would tend to stay at rest when the handgun 10 kicks backward as a result of firing.

FIGS. 6, 7, 8, and 9 illustrate various side plates 24, which are more specifically identified by the reference characters 24A, 24B and 24C, which have respective lips 26 of various thicknesses. The thickness of the lip 26 will vary for particular applications depending upon the clearance required for a cylinder 30, which must rotate out to one side, as viewed in FIG. 2.

Figure 5:
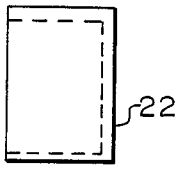
FIG. 5 is an end elevational view of the apparatus shown in FIG. 3.
Figure 7:
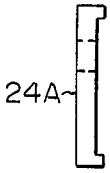
FIGS. 7, 8, and 9 are views of various side plates of different sizes which may be suitable for use with the preferred embodiment of the invention and which facilitate the adaptation of the mount in accordance with the invention to various handguns.
Figure 8:
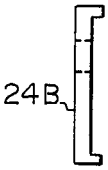
Figure 9:
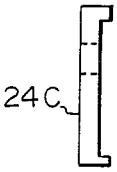

The mount base 22 preferably includes openings 42, 44, and 46 for cooperation with scope mounting rings (not shown). The side plates 24A, 24B and 24C are ordinarily attached by screws 24 and may rest in recesses 40 in the mount base 22. In various embodiments the sides of the mount base 22 may be planar or they may be recessed to accommodate the side plates 24, as in the embodiment illustrated in FIGS. 3, 4, and 5. The selection of the particular side plate 24 will vary depending on the clearance required with respect to the cylinder 30.

It will be seen that the apparatus in accordance with the invention is readily modified by varying the side plates 24 used or, alternatively, changing the recesses 40 to provide the proper alignment with the specific handgun 10 on which a scope is to be installed. Often the side plate or clamp plate 24 utilized on one side of the mount base 22 will be different from the side plate or clamp plate 24 used on the opposite side because of the requirement to clear the cylinder 30 as it is swung out.

Figure 3:
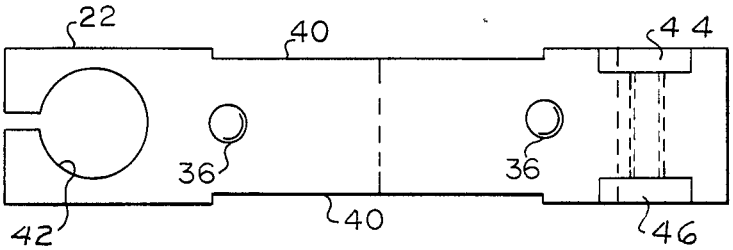
FIG. 3 is a plan view of the base used in one specific embodiment of the apparatus in accordance with the invention.

Customarily, the installation procedure involves removing the rear sight (not shown) and inserting a steel plug in the sight screw hole. A first side plate 24 is attached to the mount base 22. The mount base 22 and the first side plate 24 are positioned adjacent to the top strap 16 of the handgun 10. Thereafter the second side plate 24 is attached to the opposite side of the mount base 22. Each of the side plates 24 is attached by means of screws 34 which extend into the side of the mount base 22. Two set screws 36 disposed at axially spaced points inboard, as best seen in FIG. 3, are then adjusted so that they contact the top strap 16 and force the mount base 22 upwardly to the position shown in FIG. 2, wherein the lips 26 firmly contact the bottom extremity of the top strap 16. To protect the finish of the top strap 16, a lead shot (not shown) may be positioned intermediate the lower extremity of each set or jack screw 36 and the top strap 16. It will be seen that when the set or jack screws 36 are thus extended the mount base 22 is precisely positioned in parallel relationship with the bore of the barrel 14. It will be understood that the side plates 24 are designed to firmly grip the sides of the top strap 16 and, thus, optimimum alignment with the center line of the bore is achieved.

Ordinarily the set screws 36 will be manufactured of brass or other metal. Material such as nylon will tend to cold flow and, thus, not provide a positive positioning of the apparatus.

Although the invention has primary application to revolvers, it will be understood to also have application to other handguns such as automatic and semi-automatic weapons.

It will be seen that the apparatus in accordance with the invention makes possible a standard design which, with very minor adaptation of the side plates 24 or the mount base 22, will fit any revolver.

The invention has been described with reference to its illustrated preferred embodiment. Persons skilled in the art of constructing scope mounts may, upon exposure to the teachings herein, conceive variations in the mechanical development of the components therein. Such variations are deemed to be encompassed by the disclosure, the invention being delimited only by the appended claims.

I claim:

1. A mount for a scope dimensioned and configured for mounting on the top of an associated handgun, which comprises:

a base; and first and second side plates depending from said base, each of said side plates having an inwardly extending lip, both of said side plates being removably mounted on said base, said base having first and second set screws disposed therein for engagement at axially spaced points along the top surface of the associated handgun.

2. The apparatus as described in claim 1, wherein:

said base has first and second elongated recesses for cooperation respectively with said first and second side plates, each of said side plates being disposed in end abutting relationship with the extremities of the cooperating elongated recess in said base when said mount is installed on the associated handgun.

3. The apparatus as described in claim 2, wherein:

said first side plate has a thickness that differs from the thickness of said second side plate to provide clearance for a cylinder.

* * * * *